United States Patent [19]

Newcombe

[11] 4,261,812

[45] Apr. 14, 1981

[54] EMULSION BREAKING PROCESS

[75] Inventor: Jack Newcombe, Tulsa, Okla.

[73] Assignee: Cities Service Company, Tulsa, Okla.

[21] Appl. No.: 112,999

[22] Filed: Jan. 17, 1980

[51] Int. Cl.[3] ..... C01G 33/04

[52] U.S. Cl. ..... 208/188; 166/267; 210/708; 252/332; 252/333

[58] Field of Search ..... 208/188; 166/267; 210/51; 252/332, 333

[56] References Cited

U.S. PATENT DOCUMENTS

| | | | |
|---|---|---|---|
| 2,964,478 | 12/1960 | Monson | 208/188 |
| 4,029,570 | 6/1977 | Coffman et al. | 208/188 |

FOREIGN PATENT DOCUMENTS

| | | | |
|---|---|---|---|
| 406694 | 12/1943 | Italy | 208/188 |
| 412225 | 1/1974 | U.S.S.R. | 208/188 |

*Primary Examiner*—Brian E. Hearn

*Attorney, Agent, or Firm*—Richard D. Stone

[57] ABSTRACT

An oil-in-water emulsion of crude oil, water and surface active agents is broken by adding additional surface active agents, preferably relatively high equivalent weight petroleum sulfonates, to the emulsion and then subjecting the emulsion to conventional emulsion breaking techniques.

8 Claims, No Drawings

EMULSION BREAKING PROCESS

This invention relates to the recovery of petroleum from underground reservoirs and pertains in particular to the breaking of emulsions of crude oil and water that are recovered from a producing well of the reservoir.

Recovered liquid from a producing well can be in the form of oil and water emulsions which are quite stable, especially when they contain a surfactant which was introduced into the reservoir for enhancing the recovery of crude oil. Surfactants are added to a reservoir in the form of a solution or dispersion which is either miscible with the crude oil or lowers the surface tension between the water and oil phases encountered in the formation. Frequently, thickened water is injected into a reservoir to displace crude oil to a producing well. These ingredients, surfactant, oil, water and thickening agents produce very stable emulsions.

It is anticipated that in most enhanced recovery processes significant amounts of water will be produced, as well as oil. This is because all easily recoverable oil has usually been removed from a reservoir, usually by water flooding, before an enhanced recovery process is begun. Breaking of emulsions produced in a tertiary recovery operation will be difficult because the surface active agents will not only encourage the formation of emulsions, but tend to stabilize them. Further, there will not be very much oil in most of these emulsions, from 1 to 30 LV% oil may be expected, with 5 to 20 LV% oil being most commonly encountered.

Because of the amounts of oil and water, the emulsion expected will be an oil-in-water, o/w, emulsion. These emulsions are not usually encountered in petroleum production, the expected form is a water-in-oil, w/o, emulsion. Conventional emulsion breaking techniques which work on a w/o emulsion are ineffective in breaking an o/w emulsion.

PRIOR ART

An excellent method of breaking an oil-in-water emulsion of the type described above is given in U.S. Pat. No. 4,029,570 (Class 208/188), Coffman, et al., the teachings of which patent are incorporated by reference. Coffman contacts the emulsion with formation brine to produce an oil phase and a water phase. This method will break o/w emulsions characterized by high surfactant contents; however, the produced oil phase sometimes contains unacceptable amounts of water, e.g., in Example IV, 100 ml of crude oil was recovered as 108 ml of an oil phase, presumably containing about 8 ml water. The generally accepted maximum water content of oil destined for pipe line transmission is about 1 wt %.

Complicating the problem further, some emulsion breaking techniques, such as treatment with brine described above, will work on fluids pumped into the, ground, but will not work on produced fluids. The problem is the tendency of formation rock to absorb selectively high equivalent weight sulfonates, leaving low equivalent weight sulfonates behind. The net effect is that the surfactant produced in micellar or surfactant floods is more hydrophilic than the injected surfactant. If the surfactant is highly hydrophilic, the o/w emulsion may resist breaking by brine.

It would be beneficial if a process were provided to break these emulsions, and produce a sprung oil of reduced water content.

SUMMARY OF THE INVENTION

Accordingly, the present invention provides an improved process for recovering crude oil from an oil-in-water emulsion of crude oil, water and surface active agents, produced from a reservoir, wherein the emulsion is contacted with an emulsion breaking reagent, the improvement comprising adding additional surface active agent with an average equivalent weight higher than the equivalent weight of the surface active agents in the produced emulsion, and then subjecting this emulsion to emulsion breaking and recovering crude oil from the resultant broken emulsion.

In another embodiment, the present invention provides an improved process for recovering crude oil from an emulsion produced from a reservoir as the product of a tertiary oil recovery process wherein a surfactant flood is employed to produce an oil-in-water emulsion comprising crude oil, water, and a sulfonate surfactant, wherein the produced emulsion is broken using brine, the improvement which comprises adding to the produced emulsion additional sulfonate surfactant having an average equivalent weight of 400 to 600 in an amount equivalent to 10 to 100 wt % of the surfactant present in the produced emulsion, and then subjecting the emulsion to conventional emulsion breaking with brine.

DETAILED DESCRIPTION

The emulsions which can be treated in the practice of the present invention are any oil-in-water emulsions characterized by the presence of surface active agents. These emulsions may contain 1 to 30 LV% oil, with the remainder being water. Surfactant concentration may range from 50 ppm to 5.0 wt %, based on the total weight of the emulsion. The surfactants used in the practice of the present invention can be any sulfonates used in enhanced recovery processes. Sodium petroleum sulfonates are especially preferred, because of their effectiveness, ready availability, and ease of molecular weight adjustment.

Even if only a single source of sulfonates is used, labeled with a designation that the average equivalent weight is, e.g., 435, the product actually contains a fairly broad distribution of equivalent weights. The term equivalent weight is simply the molecular weight divided by the average number of sulfonate groups. If the average molecular weight of a molecule is 500, and contains an average of 1.25 sulfonate groups, the equivalent weight is 400. A range of equivalent weight is encountered because the feedstocks used are obtained by fractionation, and there are always some materials lighter and heavier than the average molecular weight of the product. This property, a distribution of equivalent weights, is beneficial in that the best surfactants tend to have a range of equivalent weights because the oils encountered also have a range of molecular weights. Thus, even if it were possible to obtain a surfactant consisting of a single equivalent weight sodium petroleum sulfonate, it is unlikely that such a material would be used because it probably would not provide the best effect in the ground. Once a blend of sulfonates is used, the rocks will tend to selectively absorb the higher equivalent weight sulfonates, effectively changing the equivalent weight distribution of the surfactant.

Other materials which may be present in the produced emulsions are various thickening agents such as biopolymers or synthetic polymers, e.g., polyacrylamides. Electrolytes or salts may be present, either because they were added to fluids pumped into the formation or were present in the connate water. Co-surfactants, such as alcohols, alkylethoxy sulfates, and alkylcellosolves may be encountered as well. None of the materials mentioned in this paragraph are individually needed for a tertiary recovery process, though they are frequently encountered. When encountered, they may produce emulsions which are difficult to break.

The emulsion breaking process of the present invention may be practiced either in batch fashion or continuously. Batch operation is relatively simple and requires little extra equipment, merely a large tank with a mixer or circulating pump. Continuous operation is preferred, but would require a much more elaborate equipment layout than could be provided at most producing wells, e.g., an emulsion holding tank, metering pump to add high equivalent weight sulfonates, metering pumps for brine addition, settling tanks for emulsion breaking, and associated hardware and pumps for transferring fluid from one step to another.

The continuous process may be preferred in flooding relatively large or giant fields. High equivalent weight sulfonate would be added to produced emulsions, producing a sprung oil phase of reduced water content and which contains the major amount of added sulfonate and the sulfonate originally contained in the emulsion.

EXAMPLE 1

An o/w emulsion as prepared by mixing 120 ml of "69 Oil" micellar fluid with 390 ml of deionized water at the high speed of a laboratory Waring blender to produce 510 ml of emulsion. The composition of the "69 Oil" was:

| | |
|---|---|
| Sodium petroleum sulfonate | 1.28 g/100 ml fluid |
| n-Butylcellosolve | 0.24 g/100 ml fluid |
| Water | 0.40 g/100 ml fluid |
| Balance crude oil to make up to | 100 ml volume |

The average equivalent weight of the sulfonate is 421 with the following weight distribution:

| Equivalent Weight | Weight % |
|---|---|
| 346 and below | 18 |
| 346 to 466 | 39 |
| 466 and above | 43 |

The crude oil used is a field crude of 35° API gravity having a viscosity of 5.1 centipoise at 75° F.

The equivalent weight of the sulfonate was adjusted by adding either a relatively high or low equivalent weight sodium petroleum sulfonate. The high equivalent weight sodium petroleum sulfonate used was TRS-HMW, which has an average equivalent weight of 547.5. The low equivalent weight material used was TRS-40, which has an average equivalent weight of 340. The TRS-HMW and TRS-40 are available from the Witco Chemical Corporation.

The 510 ml of o/w emulsion prepared was divided into six portions, 85 ml each. The samples were placed in six graduated cylinders. Half of the cylinders contained graduated, increasing amounts of high molecular weight material. TRS-HMW. The TRS-HMW was dissolved in a liquid consisting of 20 LV% benzene and 80 LV% isopropyl alcohol. The concentration of sulfonate in solvent was 5 wt %. These three cylinders contained 500, 1,000 and 2,000 wt ppm TRS-HMW. In the other three cylinders, similar amounts of low equivalent weight sulfonate, TRS-40 were added.

The six graduates, plus another graduate containing a blank or control emulsion with no additive, were shaken by hand for two minutes. Ten ml of formation brine containing 10 wt % salts was then added to each graduate. This brine contained the following salt breakdown:

| | |
|---|---|
| 84.8 wt % | sodium chloride |
| 0.3 wt % | potassium chloride |
| 6.1 wt % | calcium chloride |
| 8.1 wt % | magnesium chloride |
| 0.7 wt % | barium chloride |

The volume in each graduate was adjusted to exactly 100 ml by adding deionized water. The graduates were again shaken vigorously for two minutes and then allowed to stand 24 hours. Oil was sampled for water analysis. The Karl Fischer method was used to analyze for water in the oil.

An o/w emulsion was prepared from "B Oil" exactly as described for "69 Oil" above. Composition of "B Oil" is as follows:

| | |
|---|---|
| Sodium petroleum sulfonate | 1.129 g/100 ml fluid |
| n-Butyl cellosolve | 0.38 g/100 ml fluid |
| Water | 0.87 g/100 ml fluid |
| Balance crude oil to make up to 100 ml volume. | |

The average equivalent weight of the sulfonate is 378 and it has the following weight distribution:

| Equivalent Weight | Weight |
|---|---|
| 340 | 53.9 |
| 422.5 | 37.1 |
| 500 | 9.0 |

Samples of the emulsion of "B Oil" were treated by addition of TRS-HMW to increase the equivalent weight of the sulfonate to the values listed in Table I.

Test results on these two fluids are reported in Table I.

TABLE I

| Emulsion | Sulfonate Added | Conc PPM | Total Conc PPM | Ave Equiv. Wt | Water Content of Oil, Wt % |
|---|---|---|---|---|---|
| 69 Oil | None | — | 2560 | 421 | 4.73 |
| 69 Oil | TRS-HMW | 500 | 3060 | 437.5 | 1.40 |
| 69 Oil | TRS-HMW | 1000 | 3560 | 450.2 | 2.12 |
| 69 Oil | TRS-HMW | 2000 | 4560 | 468.5 | 1.90 |
| 69 Oil | TRS-40 | 500 | 3060 | 405 | 6.57 |
| 69 Oil | TRS-40 | 1000 | 3560 | 394 | 8.53 |
| 69 Oil | TRS-40 | 2000 | 4560 | 381 | 11.55 |
| B Oil | none | — | 2258 | 378 | 9.68 |
| B Oil | TRS-HMH | 500 | 2758 | 400.4 | 6.42 |
| B Oil | TRS-HMH | 1000 | 3258 | 417.7 | 4.80 |
| B Oil | TRS-HMH | 2000 | 4258 | 442.3 | 1.85 |

The results of Table I indicate that adding a relatively low equivalent weight sulfonate results in a more stable emulsion, or a sprung oil with a relatively high water content. Surprisingly, adding a relatively high equivalent weight sulfonate, TRS-HMW, lowered the water content of the sprung oil.

In treating the emulsions derived from the "69 Oil" micellar fluid, the optimum amount of additional TRS-HMW was relatively low, about 500 ppm added. Addition of 2 to 4 times this amount resulted in sprung oil with a somewhat higher water content, though all of the water contents of the sprung oil were lower after addition of TRS-HMW than the control sample, which contained no added TRS-HMW.

When treating emulsions obtained from "B Oil" micellar solution, adding more high equivalent weight sulfonate seem to improve results. This may mean that the optimum average equivalent weight, for breaking this emulsion is about 437.5, based on 69 Oil experiments, and I have never added enough TRS-HMW to see a rise in water content.

EXAMPLE 2

A water external micellar fluid designated "100 Micellar Fluid" contained the following components:

| | Wt % |
|---|---|
| Sodium petroleum sulfonate, 340 ew, 40% active | 5.740 |
| Sodium alcohol ethoxylate sulfate 442 ew, 58% act. | 2.157 |
| sec-Butyl alcohol | 0.88 |
| Polyacrylamide polymer | 0.08 |
| Sodium hydrosulfite | 0.01 |
| Formation brine (contains 10 wt % salts) | 5.00 |
| Soft water | 86.13 |
| | 100.000 |
| Average equivalent weight of surfactant | 370 |

The active surfactant components in the fluid are:

| | |
|---|---|
| Sulfonate | 2.297 wt% |
| Sulfate | 1.251 wt% |
| | 3.547 wt% |

This water-external micellar fluid was mixed with crude oil and water for 2 minutes at the high speed of a Waring blender to produce 20 LV% oil and 5 LV% oil emulsions of the concentrations of surfactant stated in Table II. These o/w emulsions were prepared to simulate produced fluids depleted of high equivalent weight surfactant components by adsorption in reservoir rock.

The emulsion stability was studied by placing 100 ml of emulsion in a 400 ml beaker and stirring at 300 to 3000 rpm while adding formation brine to the break point as hereinafter defined. A glass turbine stirrer, Ace Glass #8068B for 250–5000 ml capacity containers, driven with a Fisher Stedi-Speed motor stirrer, was used. This four-bladed stirrer is 2.54 cm in diameter, of 1.5 cm depth, and has 0.2 cm pitch. The break point occurs when the emulsion darkens, foam disappears, the stirred emulsion becomes non-uniform, and phase separation occurs. After the break point, excess brine was added and the broken emulsion stirred further. The broken emulsion was transferred to a stoppered 100 ml graduated cylinder and allowed to separate over a 24 hour period. Observations were made at 1 hour and 4 hours. After 24 hours, the oil was sampled for Karl Fischer water analysis. Results are reported in Table II.

TABLE II

| Exp. No. | LV% Oil in Em. | Surfactant g/100 ml Oil* | Surfactant g/100 ml Emulsion | TRS-HMW added, g | ml Brine Added To Break | ml Brine Added Total | Stirring rpm | Stirring Min | Wt % $H_2O$ | Ave Adjusted Equivalent Weight |
|---|---|---|---|---|---|---|---|---|---|---|
| 1 | 20 | 12.5 | 2.5 | 0 | no | 3000 | — | — | — | 370 |
| 2 | 20 | 12.5 | 2.5 | Added 100 ml brine, no break, Added 0.1 g. Arq. 2C, no break, Added 0.2 g. TRS HMW, broke, did not sample | | | | | | 379 |
| 3 | 20 | 12.5 | 2.5 | 0.4 | 100 | 130 | 3000 | 10 | 0.03 | 387 |
| 4 | 20 | 12.5 | 2.5 | 0.6 | 100 | 120 | 3000 | 10 | — | 395 |
| 5 | 5 | 12.5 | 0.625 | 0 | no | 3000 | — | — | — | 370 |
| 5a | 5 | 12.5 | 0.625 | 0.5 | 9.5 | 20 | 3000 | 10 | 33.3 | 432 |
| 8 | 5 | 12.5 | 0.625 | 0.25 | no | 20 | — | — | — | 407 |
| 19 | 20 | 2.5 | 0.5 | 0 | no | 3000 | — | — | — | 370 |
| 20 | 20 | 2.5 | 0.5 | 0.5 | 4.6 | 10 | 3000 | 10 | — | 441 |
| 21 | 20 | 2.5 | 0.5 | 0.5 | 4.8 | 10 | 1500 | 10 | 8.3 | 441 |
| 22 | 20 | 2.5 | 0.5 | 0.3 | 8.5 | 20 | 1500 | 10 | — | 421 |
| 23 | 20 | 2.5 | 0.5 | 0.2 | 19.6 | 40 | 1500 | 10 | — | 407 |
| 24 | 5 | 2.5 | 0.125 | 0 | no | 3000 | — | — | — | 370 |
| 25 | 5 | 2.5 | 0.125 | 0.113 | 22.3 | 45 | 1500 | 10 | — | 437 |
| 26 | 5 | 2.5 | 0.125 | 0.075 | 24.8 | 50 | 1500 | 10 | 7.3 | 421 |
| 28 | 5 | 2.5 | 0.125 | 0.050 | 29.0 | 60 | 3000 | 10 | 12.1 | 407 |
| 9 | 20 | 1.25 | 0.25 | 0 | no | 3000 | — | — | — | 370 |
| 10 | 20 | 1.25 | 0.25 | 0.25 | 8.7 | 20 | 3000 | 10 | 4.7 | 441 |
| 12 | 20 | 1.25 | 0.125 | 0.15 | 12.2 | 25 | 1500 | 10 | 5.7 | 421 |
| 13 | 20 | 1.25 | 0.25 | 0.10 | 21.0 | 45 | 1500 | 10 | — | 407 |
| 14 | 5 | 1.25 | 0.0625 | 0 | no | 3000 | — | — | — | 370 |
| 16 | 5 | 1.25 | 0.0625 | 0.0625 | 20.5 | 40 | 1500 | 10 | — | 441 |
| 17 | 5 | 1.25 | 0.0625 | 0.0375 | 24.6 | 50 | 1500 | 10 | 3.2 | 421 |
| 18 | 5 | 1.25 | 0.0625 | 0.025 | 33.4 | 70 | 1500 | 10 | 4.4 | 407 |
| 29 | 20 | 0.50 | 0.10 | 0 | no | 3000 | — | — | — | 370 |
| 31 | 20 | 0.50 | 0.10 | 0.1 | 13.2 | 25 | 500 | 10 | 1.2 | 441 |
| 32 | 20 | 0.50 | 0.10 | 0.06 | 17.3 | 35 | 500 | 10 | — | 421 |
| 33 | 20 | 0.50 | 0.10 | 0.04 | 24.5 | 60 | 500 | 10 | 2.9 | 407 |
| 34 | 5 | 0.50 | 0.025 | 0 | 110 | 250 | 500 | 10 | — | 370 |
| 35 | 5 | 0.50 | 0.025 | 0.025 | 18.2 | 40 | 500 | 10 | — | 441 |
| 37 | 5 | 0.50 | 0.025 | 0.01 | 30.5 | 65 | 500 | 10 | 1.7 | 407 |
| 38 | 5 | 0.50 | 0.025 | 0.005 | 34.9 | 75 | 500 | 10 | — | 391 |
| 39 | 20 | 0.25 | 0.05 | 0 | 18.5 | 40 | 500 | 10 | — | 370 |
| 40 | 20 | 0.25 | 0.05 | 0.05 | 9.3 | 20 | 500 | 10 | 0.56 | 441 |
| 41 | 20 | 0.25 | 0.05 | 0.03 | 11.7 | 25 | 500 | 10 | 0.65 | 421 |
| 48 | 5 | 0.25 | 0.0125 | 0 | 26.7 | 60 | 500 | 10 | 0.11 | 370 |
| 46 | 5 | 0.25 | 0.0125 | 0.005 | 17.8 | 50 | 500 | 10 | 0.54 | 407 |

TABLE II-continued

| Exp. No. | LV% Oil in Em. | Surfactant g/100 ml Oil* | Surfactant g/100 ml Emulsion | TRS-HMW added, g | ml Brine Added To Break | ml Brine Added Total | Stirring rpm | Stirring Min | Wt % $H_2O$ | Ave Adjusted Equivalent Weight |
|---|---|---|---|---|---|---|---|---|---|---|
| 53 | 20 | 0.125 | 0.025 | 0 | 12.4 | 30 | 300 | 10 | 0.3 | 370 |
| 51 | 20 | 0.125 | 0.025 | 0.015 | 8.8 | 20 | 300 | 10 | 0.8 | 421 |
| 58 | 5 | 0.125 | 0.00625 | 0 | 28.4 | 60 | 300 | 10 | — | 370 |
| 57 | 5 | 0.125 | 0.00625 | 0.00125 | 22.5 | 50 | 300 | 10 | 0.19 | 391 |
| 59 | 20 | 0.0125 | 0.0025 | 0 | 21 | 50 | 400 | 10 | — | 370 |
| 61 | 20 | 0.0125 | 0.0025 | 0.0015 | 13.6 | 30 | 300 | 10 | 0.04 | 421 |
| 66 | 5 | 0.0125 | 0.000625 | 0.00025 | 75 | 75 | 300 | 20 | 0.09 | 407 |
| 67 | 5 | 0.0125 | 0.000625 | 0.00125 | 75 | 75 | 300 | 20 | 0.37 | 472 |

*Assuming that surfactant partitioned from water into the oil phase.

Emulsions prepared from 370 ew sulfonate did not break on addition of brine except for the low surfactant content emulsions. However, if high equivalent weight sodium petroleum sulfonate, TRS-HMW of 547.5 equivalent weight, is added to the emulsion and stirred for several minutes to mix thoroughly, the emulsion breaks readily on addition of brine.

Results in Table II illustrate this very well. In the first experiment, 100 ml of emulsion which contains 2.5 g of surfactant did not break or even change in appearance as formation brine was added. Even adding a total of 3000 ml did not break the emulsion. In Exp. 2, 100 ml of brine plus 0.1 g dicocodimethylammonium chloride (Arquad 2C) plus 0.2 g TRS-HMW did result in a slow break of the emulsion, but not sufficiently to spring all of the oil after 24 hours. By adding 0.4 g of TRS-HMW into the emulsion, some break was in evidence after 100 ml of brine was added. A total of 130 ml of brine was added and the mixture stirred at 3000 rpm for 10 minutes. On standing 24 hours, most of the oil had separated, but some o/w emulsion was still present. The sprung oil contained only 0.03 wt % water.

In testing emulsion No. 5 containing 0.625 g surfactant, addition of 3000 ml of brine did not break it. As shown in Exp. 5a, 0.5 g of TRS-HMW was added as a 5 g/100 ml solution of 80 LV% isopropyl alcohol and 20 LV% benzene. After stirring for 10 minutes to thoroughly mix the sulfonate into the emulsion, it was found to break sharply after addition of 9.5 ml of brine. The oil broke cleanly from the brine on standing for 24 hours, but because of the large amount of surfactant in the oil it contained 33.3 wt % water. Calculations show that the average equivalent weight of the surfactant in the emulsion was increased from 370 to 432 in Exp. 5a. In Exp. 8, 0.25 g of TRS-HMW was added, increasing ew to 407, but 20 ml of brine was not sufficient to break this emulsion cleanly as in Exp. 5a.

In Exp. 19, 100 ml of emulsion containing 0.5 g of surfactant did not break on addition of 3000 ml of brine. However, adding TRS-HMW did allow good breaking of the emulsion. This is shown in Exps. 20 and 21. Addition of 0.5 g TRS-HMW gave a total of 1.00 g surfactant in the emulsion and a 441 ew. This emulsion broke cleanly on addition of 4.6 to 4.8 ml brine to spring an oil containing 8.3 wt % water. In Exp. 22, adding 0.3 g of TRS-HMW, for a total of 0.8 g surfactant with an adjusted ew of 421, produced an emulsion which broke cleanly on addition of 8.5 ml of brine. In Exp. 23, 0.2 g of TRS-HMW was added to give an emulsion containing 0.7 g surfactant with an adjusted ew of 407. This emulsion required 19.6 ml of brine to break. This may be getting close to the borderline between breaking cleanly and not quite a satisfactory break.

The 5 LV% oil emulsion, Exp. 24, 0.125 g surfactant per 100 ml emulsion, did not break on addition of 3000 ml of brine. It broke readily when adjusted to 421 ew by addition of 0.075 g TRS-HMW in Exp. 26. It also broke on adjustment to a 407 ew by addition of 0.05 g TRS-HMW in Exp. 28.

For the 20 LV% oil, 0.25 g surfactant emulsions, of Exps. 9–13, the effect of adjustment of surfactant ew is shown below:

| Exp. No. | TRS-HMW, g | Adjusted ew | Break |
|---|---|---|---|
| 9 | None | 370 | No |
| 13 | 0.1 | 407 | Borderline |
| 12 | 0.15 | 421 | Yes |
| 10 | 0.25 | 441 | Yes |

For the 5 LV% oil, 0.0625 g surfactant emulsions of Exps. 14–18, the effect of adjustment of surfactant ew is shown below:

| Exp. No. | TRS-HMW, g | Adjusted ew | Break |
|---|---|---|---|
| 14 | None | 370 | No |
| 18 | 0.025 | 407 | Break |
| 17 | 0.0375 | 421 | Break |
| 16 | 0.0625 | 441 | Break |

The 20 LV% oil, 0.10 g surfactant/100 ml emulsion, Exp. 29, did not break on addition of 3000 ml of brine. When adjusted to a 407 ew in Exp. 33, it broke readily on addition of brine to spring an oil containing 2.9 wt % water. When adjusted to a 441 ew by addtition of 0.1 g TRS-HMW, Exp. 31, the emulsion broke with 13.2 ml of brine to spring oil containing 1.2 wt % water.

Low surfactant content emulsions containing 0.05 g/100 ml for 20 LV% oil emulsions and 0.0125 g/100 ml for 5 LV% oil emulsions broke well with added brine without adjustment of equivalent weight. However, less brine was required to break the emulsion as the surfactant ew was increased.

EXAMPLE 3

This example shows that when the emulsion contains a relatively high equivalent weight sulfonate, simple brine addition can be used to break the emulsion.

A water-external micellar fluid was prepared like the "100 Micellar Fluid" of Example 2 except that some high ew sulfonate was included in the formation. The active surfactant components in this fluid designated as "82-3 Micellar Fluid" are:

| | Wt % |
|---|---|
| Sodium petroleum sulfonate | |
| 470 ew | 1.656 |
| 340 ew | 1.224 |
| Sodium alcohol ethoxylate sulfate, | |
| 442 ew | 0.667 |
| | 3.547 |
| Average ew of surfactant | 410 |

Emulsions were prepared by mixing crude oil, "82-3 Micellar Fluid", and water for two minutes at the high speed of a Waring blender to produce 20 LV% oil, and 5 LV% oil w/o emulsions of the same surfactant content as the emulsions listed in Table II. These emulsions are typical of those produced from a more balanced surfactant system in a micellar fluid. These emulsions broke readily on addition of brine as shown in Table III, presented hereinafter. The surfactant mixture is much less hydrophilic because the sulfonate has a higher ew and because of the smaller amount of sulfate component.

panies, which cost 10 to 20 times as much per weight of active component.

The present invention will enable brine to be used to break o/w emulsions in which the high equivalent weight sulfonates or other hydrophobic components have been lost during contact with formation rock and residual oil. Otherwise such emulsions must be heated and treated with high cost chemicals to break the emulsion.

Another use is to resolve and break the emulsions in which the emulsifier system of the micellar fluid is designed to be used in highly saline reservoirs. Adjustment of emulsifier to a more hydrophobic balance with added high equivalent weight sulfonate will enable produced fluids to be treated with brine to break the emulsion even though the micellar fluid was designed to be stable when in contact with formation brine in the oil reservoir.

In the field, this invention would be used whenever conventional emulsion breaking techniques, e.g., treatment with brine, did not produce a satisfactory sprung oil. A detailed chemical analysis of the surfactant in the produced emulsion could be made, and from that analysis, a decision made as to the amount and equivalent weight of additional surfactant required. A simpler procedure, and one which would be most convenient in the field, would be to add some additional high equivalent weight sulfonate to the produced emulsion, and subject this sample to emulsion breaking with brine. It is difficult to generalize on the amount of high equivalent weight surfactant required, this will vary with the amount of oil in the emulsion, the amount of surfactant in the oil, and the presence of other materials such as electrolytes which can drastically change the amount of additional high equivalent weight surfactant required.

The high equivalent weight sulfonate could be stored as a liquid solution much as was done in the examples, but this would be prohibitively expensive. Usually the petroleum sulfonates are available in liquid form, which is not 100% active material, but cost is minimized and handling of the material if facilitated. It may be desirable to mix the surfactant with a predetermined amount of water or crude oil to facilitate mixing of surfactant

TABLE III

| | | Surfactant, Wt % In | | ml Brine | | Stirring | | Wt % $H_2O$ |
|---|---|---|---|---|---|---|---|---|
| Exp. No. | LV% Oil | Oil* | Em | To Break | Total | rpm | Min. | in Oil |
| 3 | 20 | 12.5 | 2.5 | 20 | 50 | 3000 | 10 | 36.2 |
| 6 | 5 | 12.5 | 0.625 | 15 | 50 | 3000 | 10 | 48.9 |
| 8 | 20 | 2.5 | 0.5 | 8 | 20 | 1500 | 10 | 8.94 |
| 12 | 5 | 2.5 | 0.125 | 12 | 20 | 3000 | 10 | 6.68 |
| 13 | 20 | 1.25 | 0.25 | 8 | 20 | 1000 | 10 | 3.10 |
| 15 | 20 | 1.25 | 0.25 | 8 | 20 | 3000 | 10 | 4.22 |
| 17 | 5 | 1.25 | 0.0625 | 12.5 | 25 | 3000 | 10 | 9.40 |
| 18 | 20 | 0.50 | 0.10 | 10 | 20 | 500 | 10 | 0.20 |
| 19 | 20 | 0.50 | 0.10 | 10 | 20 | 750 | 10 | 0.30 |
| 22 | 5 | 0.50 | 0.025 | 12.5 | 25 | 1000 | 10 | 1.92 |
| 24 | 20 | 0.25 | 0.05 | 7.5 | 25 | 1000 | 10 | 0.16 |
| 25 | 5 | 0.25 | 0.0125 | 12.2 | 25 | 1000 | 10 | 2.72 |
| 27 | 20 | 0.125 | 0.025 | 7 | 25 | 500 | 10 | 0.09 |
| 30 | 5 | 0.125 | 0.00625 | 12.5 | 25 | 750 | 10 | 0.54 |
| 31 | 20 | 0.0125 | 0.0025 | 4.5 | 25 | 500 | 10 | 0.03 |
| 32 | 20 | 0.0125 | 0.0025 | Added 500 PPM TRS-HMW | | | | |
| | | | | 5.0 | 22.5 | 3000 | 5 | 0.17 |
| 33 | 5 | 0.0125 | 0.000625 | 5 | 25 | 500 | 10 | 2.05 |
| 34 | 5 | 0.0125 | 0.000625 | Added 500 PPM TRS HMW | | | | |
| | | | | 5 | 25 | 750 | 10 | 0.81 |

*Calculated assuming all surfactant transferred into the oil phase.

Experiments 31, 32, 33 and 34 show the effect of adding some additional high equivalent weight surfactant to the emulsion. No improvement was seen in Exp. 32, some improvement was seen in Exp. 34. In the field, the brine emulsion breaking process used in Exp. 31 would be adequate because the water content of the sprung oil was very low. Practice of the present invention, Exp. 34, would be needed to make a low water content sprung oil from the emulsion of Exp. 33.

Addition of high equivalent weight sodium petroleum sulfonate to o/w emulsions to adjust the equivalent weight of the emulsifier or, surfactant, upwards and thus make the emulsion less hydrophilic can be utilized in several ways.

For a given emulsion that already can be broken with brine, it will usually allow the emulsion to be broken with less brine. It will usually produce a sprung oil that contains less water than it otherwise would. It will allow the use of less added proprietary emulsion breaker to reach a low water level. Sodium petroleum sulfonate is much cheaper than proprietary reverse emulsion breaking products from oil field service comwith the emulsion. Produced oil or water could be used for this purpose.

Mixing of the high equivalent weight surfactant into the emulsion is easily accomplished, either a large tank with a stirrer could be provided, or simply a length of pipe with a valve partially closed could be used to mix sulfonate with produced emulsion. Once the sulfonate is mixed with the produced emulsion, conventional emulsion breaking equipment and techniques can be used to resolve the emulsion into oil and water phases.

What is claimed is:

1. In a process for recovering crude oil from an oil-in-water emulsion of crude oil, water and sulfonate surface active agents, produced from a reservoir, wherein the emulsion is contacted with an emulsion breaking reagent, the improvement comprising adding additional sulfonate surface active agent, with an average equivalent weight higher than the average equivalent weight of the sulfonate surface active agents in the produced emulsion, and then subjecting this emulsion to emulsion breaking and recovering crude oil from the resultant broken emulsion.

2. Process of claim 1 wherein the emulsion is broken by contacting it with brine.

3. Process of claim 1 wherein the surface active agents are petroleum sulfonates and derivatives thereof.

4. Process of claim 1 wherein the surface active agents are petroleum sulfonates with an average equivalent weight of less than 400 in the produced emulsion, and wherein the additional surface active agent added to the emulsion is a petroleum sulfonate with (added to the produced emulsion has) an average equivalent weight between 400 and 600.

5. Process of claim 4 wherein the weight of added surfactant is equivalent to 10 to 100 wt % of surfactant present in the produced emulsion.

6. Process of claim 1 wherein the produced emulsion contains 1 to 30 LV% oil and the produced emulsion contains 0.0005 to 5.0 grams of surfactant per 100 ml of emulsion.

7. In a process for recovering crude oil from an emulsion produced from a reservoir as the product of a tertiary oil recovery process wherein a surfactant flood is employed to produce an oil-in-water emulsion comprising crude oil, water, and a sulfonate surfactant, wherein the produced emulsion is broken using brine, the improvement which comprises adding to the produced emulsion additional sulfonate surfactant having an average equivalent weight of 400 to 600 in an amount equivalent to 10 to 100 wt % of the surfactant present in the produced emulsion and then subjecting the emulsion to conventional emulsion breaking with brine.

8. Process of claim 7 wherein the produced emulsion contains 0.01 to 2.0 wt % surfactant.

* * * * *